US012514315B2

(12) United States Patent
Gulevskis

(10) Patent No.: US 12,514,315 B2
(45) Date of Patent: Jan. 6, 2026

(54) ELEMENT FOR PROVIDING AN AIR EXCHANGE BETWEEN THE INTERNAL MICROENVIRONMENT AND THE EXTERNAL ENVIRONMENT

(71) Applicant: Agris Gulevskis, Ropazi (LV)

(72) Inventor: Agris Gulevskis, Ropazi (LV)

( * ) Notice: Subject to any disclaimer, the term of this patent is extended or adjusted under 35 U.S.C. 154(b) by 414 days.

(21) Appl. No.: 18/007,540

(22) PCT Filed: Apr. 16, 2021

(86) PCT No.: PCT/LV2021/050002
§ 371 (c)(1),
(2) Date: Dec. 1, 2022

(87) PCT Pub. No.: WO2021/246853
PCT Pub. Date: Dec. 9, 2021

(65) Prior Publication Data

US 2023/0210199 A1 Jul. 6, 2023

(30) Foreign Application Priority Data

Jun. 2, 2020 (LV) ..... LVP2020000044

(51) Int. Cl.
*A41D 27/28* (2006.01)
*A41D 13/00* (2006.01)

(52) U.S. Cl.
CPC ..... *A41D 27/28* (2013.01); *A41D 13/001* (2013.01)

(58) Field of Classification Search
CPC . A41D 27/38; A41D 13/001; F24F 2007/005; F24F 7/00
See application file for complete search history.

(56) References Cited

U.S. PATENT DOCUMENTS 2,400,627 A * 5/1946 Chavannes ..... A41D 27/28 2/87
3,783,451 A 1/1974 Malin
(Continued)

FOREIGN PATENT DOCUMENTS

CN 202774219 U 3/2013
DE 10241024 A1 3/2004
(Continued)

OTHER PUBLICATIONS

International Search Report for PCT/LV2021/050002 prepared by the Federal Institute of Industrial Property, mailed Jul. 1, 2021, 3 pages.

*Primary Examiner* — Edelmira Bosques
*Assistant Examiner* — Michael James Giordano
(74) *Attorney, Agent, or Firm* — Brooks Kushman P.C.

(57) ABSTRACT

An element for providing air exchange between the internal microenvironment and the external environment and can be used in the production of air-permeable clothing for anti-insect's protection. The element includes: a flat part with at least one air inlet opening and a curved part with at least one air outlet that is not coaxial with the inlet opening of the flat part; the inner surface of the curved part having at least one segment of the surface of the torus obtained by a horizontal cross-section of the torus, a vertical circular cross-section parallel to the centroidal axis of the torus; the curved part is connected to the flat part so that all the inlet openings of the flat part are covered by a wall of the torus segment of the curved part and are in communication with the outlet or outlets of the curved part with the air exchange possibility.

12 Claims, 5 Drawing Sheets

(56) References Cited

U.S. PATENT DOCUMENTS

| | | | | |
|---|---|---|---|---|
| 4,270,227 | A | 6/1981 | Wolfe | |
| 4,576,087 | A | 3/1986 | Wolfe | |
| 4,716,594 | A | 1/1988 | Shannon | |
| 6,263,511 | B1 | 7/2001 | Moretti | |
| 7,140,048 | B2 | 11/2006 | Wallerstein | |
| 8,757,547 | B2 * | 6/2014 | Porte ..... | B64D 33/02<br>244/134 B |

FOREIGN PATENT DOCUMENTS

| | | | |
|---|---|---|---|
| RU | 2245666 | C1 | 2/2005 |
| RU | 2340267 | C1 | 12/2008 |
| WO | 2011063489 | A1 | 6/2011 |
| WO | 2016199322 | A1 | 12/2016 |

* cited by examiner

ELEMENT FOR PROVIDING AN AIR EXCHANGE BETWEEN THE INTERNAL MICROENVIRONMENT AND THE EXTERNAL ENVIRONMENT

CROSS-REFERENCE TO RELATED APPLICATION

This application is the U.S. national phase of PCT Application No. PCT/LV2021/050002 filed on Apr. 16, 2021, which claims priority to LV Patent Application No. LVP2020000044 filed on Jun. 2, 2020, the disclosures of which are incorporated in their entirety by reference herein.

TECHNICAL FIELD

The invention relates to an element for providing air exchange between the internal microenvironment and the external environment and can be used in the production of air-permeable clothing for anti-insects protection, its elements, blankets, sleeping bags, tents or anti-condensation materials.

PRIOR ART

Clothing designed for person's protection against rain and/or having anti-insects protection generally provides minimal air circulation. This causes both increased human sweating and formation of condensation, and an increase of body temperature, making wearing such clothing less comfortable.

Several solutions are known providing air circulation in clothing. One group of solutions proposes to make clothing from several ventilated layers which prevent the insect sting from reaching human or animal skin because it is thicker than the length of the insect sting (as disclosed, for example, in WO 2011/063489, U.S. Pat. Nos. 3,783,451, 4,716,594 or DE 10241024). However, these solutions do not provide sufficient protection against rain.

An air-permeable garment is known retaining insect stings (U.S. Pat. No. 7,140,048). The known material consists of four layers: outer and inner air-permeable fabrics, such as cotton fabric, and two impenetrable to passage of a sting interlayers containing holes, where the holes of the two interlayers are shifted laterally so that the holes do not face each other and do not form direct through holes between interlayers. Although such a technical solution can be considered a success, it is not efficient enough because it does not provide sufficient air circulation, especially in hot weather.

Another group of solutions offers to insert air-permeable elements in the garment, which ensure air circulation. For example, the solutions disclosed in CN 202774219, WO 2016/199322 or EP 1194049.

There is known a ventilation element (U.S. Pat. No. 4,576,087) comprising two curved walls with non-coaxial openings, where the two walls are mutually interconnected to form an element with an internal cavity; said element is positioned in the garment so that one uneven wall faces the wearer's body and the centre of its opening is higher than the centre of the opening of the other wall. The second wall of the element is essentially a canopy on the outside of the garment, which covers the ventilation opening in the element, preventing rainwater from entering it. The main disadvantages of this solution are the limited air circulation and the relatively large consumption of the materials.

U.S. Pat. No. 4,270,227 discloses a garment ventilation element for insertion into rainproof clothing. The known ventilation element comprises ventilation channels which point upwards. For connection to the fabric, a small part of the element also protrudes outside the outer layer of the garment. Opposite the inlet opening is the curved L-shaped part of the element, which directs the airflow upwards. When the direction of flow is perpendicular to the plane of the inlet opening, the air resistance is low, but when the flow is from the side, the vertical wall of the element causes significant air resistance and significant losses of flow energy. Due to the shape of the human body and the fact that the airflow is mainly not directly perpendicular to the plane of the opening, the ventilation of the body is significantly impeded.

DISCLOSURE OF THE INVENTION

The object of the invention is to overcome the drawbacks of the prior art and to offer a garment element or an article, such as a blanket, a tent and an element which, without increasing the thickness of the material, maintains good air permeability and mechanical properties, provides air exchange between the internal microenvironment and the external environment and protects human or animal skin from stinging or biting of various insects.

The object is achieved by a proposed element, comprising: a substantially flat part with at least one air inlet opening and a substantially curved part with at least one air outlet which is not coaxial with the inlet opening of the flat part, wherein the shape of the inner surface of the curved part comprises at least one segment of the torus surface obtained by a horizontal cross-section of the torus, a vertical circular cross-section parallel to the centroidal axis of the torus, the curved part being connected to the flat part so that all flat part inlet openings are covered by a wall of the torus segment of the curved part and are in communication with the outlet or outlets of the curved part with an air exchange possibility. According to one embodiment of the invention, said torus surface segment may be obtained by an additional two vertical cross-sections radially directed through the origin of the torus (i.e. centre of symmetry of the torus) with an angle between the cross-sectional planes from 9° to 355°, preferably from 30° to 180°. The horizontal and/or vertical circular cross-section of the torus may be along the centroidal axis of the torus. According to another embodiment of the invention, the element may comprise internal partition walls creating and separating the air channels of the element from each other. The shape of the inner surface of the curved part may comprise segments of several different geometric bodies, and on the outlet side the inner surface of the curved part may have a substantially straight shape, a shape with a widening to the outlet side or a shape with a narrowing to the outlet side.

BRIEF DESCRIPTION OF THE DRAWINGS

FIG. 2A shows the outlets of the element from the microenvironmental side, but FIG. 2B shows inlet openings from the external environment;

FIG. 3A shows the curved part of the element from the microenvironmental side, but FIG. 3B—the curved part of the element from the side, showing the inlet opening of the flat part;

FIG. 4A shows the curved part of the element with three diffuser-shaped channels terminating in the outlets, but FIG. 4B—an element from the external environment with internal partition walls, where the inlet opening is divided into three channels;

FIG. 5A shows the curved part of the element with two straight channels ending in the outlets, but FIG. 5B—the element from the external environment side with four inlet openings;

FIG. 6A shows the curved part of the element with one confusor-shaped channel terminating in an outlet opening; FIG. 6B—the location of the inlet opening as well as the possible shape; FIG. 6C—side view of the element from the side of the outlet;

Figure 1:
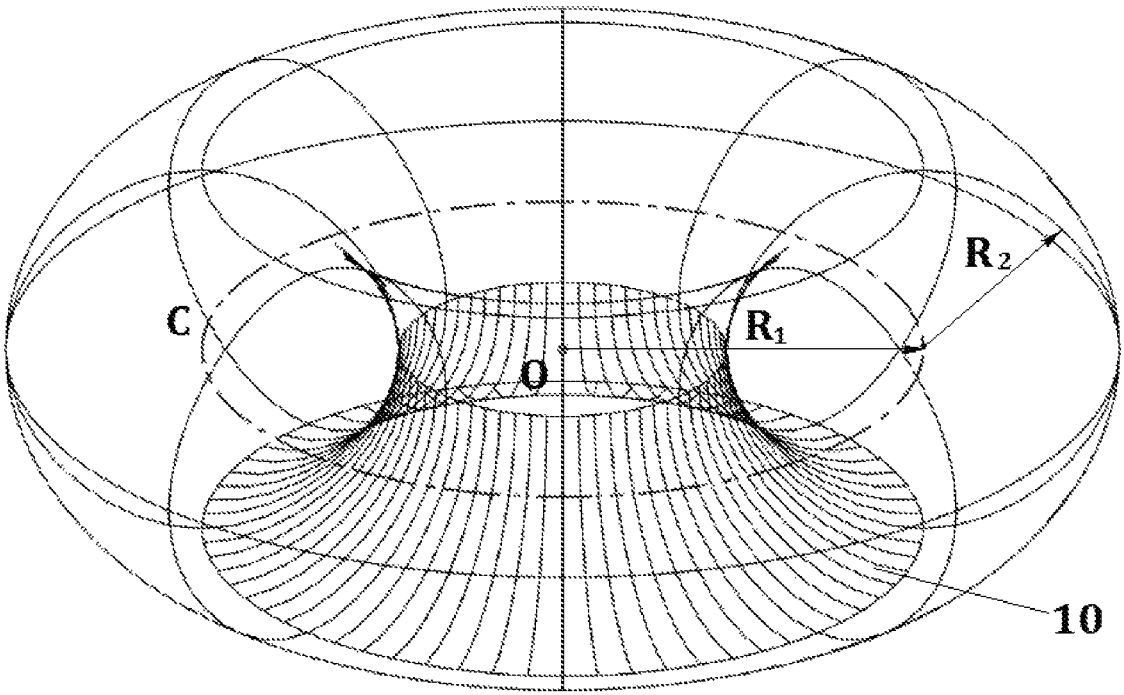
FIG. 1 shows a torus body with the designations used in the description of the invention, wherein O is the centre of symmetry of the torus (the origin of the torus), R1—major radius of the torus, R2—minor radius of the torus; C—centroidal axis of the torus; 10—a segment of the surface of the torus obtained by a horizontal cross-section of the torus and a vertical circular cross-section, which is parallel to the centroidal axis of the torus.

The element 1 designed to facilitate the exchange of air between the internal microenvironment and the external environment, as well as to protect against insects, comprises: a substantially flat part 2 with at least one air inlet opening 3 and a substantially curved part (deflector) 4 with at least one air outlet 5, which is not coaxial with the inlet opening 3 of the flat part. The flat part 2 is designed to come into contact with the surface of the material (clothing, blankets, sleeping bags, tents, anti-condensation material, etc.). The inner surfaces of the curved part 4, i.e. the shape of the airflow boundary surface (at the air inlet opening 3) comprises at least one segment of the torus surface 10 obtained by a horizontal cross-section of the torus, a vertical circular cross-section parallel to the centroidal axis of the torus. The curved part 4 is connected to the flat part 2 so that all the inlet openings 3 of the flat part 2 are covered by the wall of the torus segment 10 of the curved part 4 and are in communication with the outlet or outlets 5 of the curved part 4 with the air exchange possibility. Thus, element 1 is adapted to provide air exchange between the internal microenvironment and the external environment. In addition, the curved part 4 is arranged relative to the air inlet openings 3 so that the incoming air initially contacts the wall of the curved part 4 of the element, having the shape of the surface of the torus segment 10. The shape of the torus surface 10 gives the incoming air a certain trajectory for its further movement towards the outlet opening 5. The airflow due to wind and/or human movements is usually not directly perpendicular to the inlet openings 3 in the outer layer. The shape of the proposed element 1 ensures efficient direction of the airflow to the outlet even when the flow in the inlet opening 3 is directed, for example, at an angle of 45° to the plane of the inlet opening 3.

According to one embodiment of the invention, the element 1 prevents rain droplets from entering the internal microenvironment. In this case, the outlet 5 of the curved part 4 is directed upwards, i.e. the centre of the outlet 5 is higher than the centre of the inlet opening 3.

According to another embodiment of the invention, the torus surface segment 10 can be obtained by two additional vertical cross-sections radially directed through the centre of symmetry of the torus (torus origin) with an angle between the cross-sectional planes from 9° to 355°, preferably from 30° up to 180°. The horizontal cross-section of the torus may be along the centroidal axis of the torus or at another level (above or below the centroidal axis of the torus).

The vertical circular cross-section of the torus may also be along the cetroid axis of the torus or on either side of the centroidal axis.

According to another embodiment of the invention, the element 1 may comprise internal partition walls 6 which divide the space of the element between the flat part 2 and the curved part 4, forming separate channels provided for directing the airflow through the inlet opening 3 from the external environment to the internal microenvironment through the outlet 5. The internal partition walls 6 can be attached directly to the flat part 2 of the element 1, or to base plates 7, which are fixed to the flat part 2.

According to the embodiment of the invention, the major radius $R_1$ of the torus, which segment is used in the form of the inner surface of the curved part 4, is from 0 to 50 mm, and the minor radius R2 is from 0.5 to 49 mm.

The shape of the inner surface of the curved part 4 of the element may comprise segments of several different geometric bodies. In addition, the inside 20 of the curved part 4 on the side of the outlet opening 5 may have a straight shape, such as a cylinder cut parallel to its central longitudinal axis and perpendicular to the central longitudinal axis; a prism cut parallel to its central longitudinal axis and perpendicular to the central longitudinal axis. According to another embodiment, the inside 20 of the curved part 4 on the side of the outlet opening 5 can have the shape of a confuser or a diffuser. The confuser shape of the curved part 4 accelerates the air outflow, while the diffuser shape reduces the airflow rate and increases the static airflow pressure, as well as evenly directs the airflow over a larger area.

According to a preferable embodiment of the invention, in particular for clothing, the element 1 is made of a resilient material, but other materials can also be used for the production of rigid, inflexible elements. The element 1 may be used in the manufacture of air-permeable clothing for protection against insect stings, parts thereof, blankets, sleeping bags, tents and/or anti-condensation materials, wherein said element 1 being placed in clothing, parts thereof, blankets, tents and/or anti-condensation material so that the curved part of the element 4 faces the internal microenvironment (e.g. the wearer of the garment) and the flat part 2 faces the external environment. In the case of the use of a rain protection element (i.e. an element according to one embodiment, which prevents rain droplets from entering the internal microenvironment), the element is positioned so that the centre of the outlet 5 of the curved part 4 is spatially above all the inlet opening 3 centres of the flat part 2.

The proposed element 1 is relatively easy to manufacture by thermoforming, casting, 3D printing or other technology. The relatively small weight of the element reduces production costs due to material savings, as well as the weight of protective clothing, which is one of the most important parameters. Element 1 can be made of polymers such as polyurethane, silicone, polyvinyl chloride. The technical properties of the material used in the production of the elements depend on the required dimensions of the elements, geometric shape, placement in clothing and other factors. The connection of the element with the outer layer of the garment can be performed by gluing, hot gluing, high frequency welding or other known method depending on the type of material, properties, suitability for production processes. The outer layer of the material may be woven, knitted, made of polymeric materials, composite materials, etc.

Depending on the material used, the inlet openings 3 can be formed by laser cutting or other technology. The dimensions of the inlet openings 3 can be from 0.1 mm to 10 mm, preferably from 2 mm to 5 mm. The dimensions of the element 1 itself can be from 1 mm to 100 mm, preferably from 5 mm to 20 mm. Preferable thickness of the walls of the element—from 0.1 mm to 0.5 mm.

Examples of Implementation of the Invention

Figure 2A:
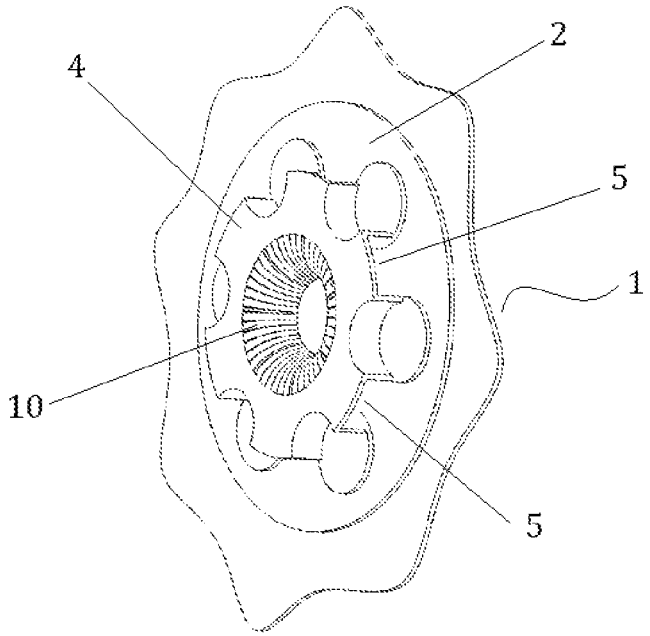
FIGS. 2A and 2B show one embodiment of the proposed element with a torus surface segment obtained with a horizontal cross-section of the torus along the centroidal axis of the torus and a vertical circular cross-section parallel to the centroidal axis of the torus.
Figure 2B:
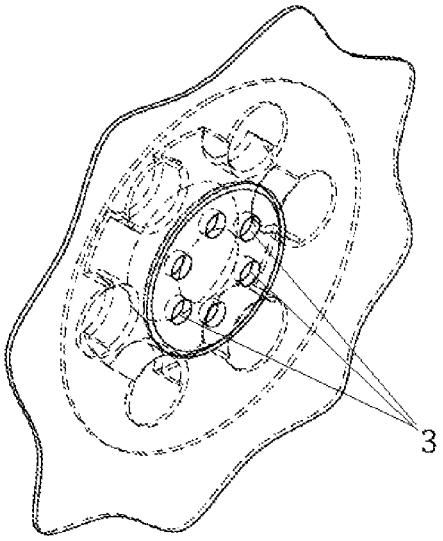

Example 1. The element 1 shown in FIG. 2A-2B comprises a torus surface segment 10 obtained by a horizontal torus cross-section along the centroidal axis of the torus and a vertical circular cross-section parallel to the centroidal axis of the torus. The element has six air inlet openings 3 (FIG. 2B) and six air outlet openings 5 (FIG. 2A). On the side of the outlet openings 5, the inside 20 of the curved part 4 (the inner surface of the channel) has a substantially straight shape. The air flowing from the external environment through the inlet opening 3 openings contacts the inner surface of the concave part torus segment 10 and is further directed to the outlet opening 5 through a straight channel. The element 1 can be attached to a garment material, sting-impermeable for insects' jaws, ensuring air exchange between the garment's internal microenvironment and the external environment.

Figure 3A:
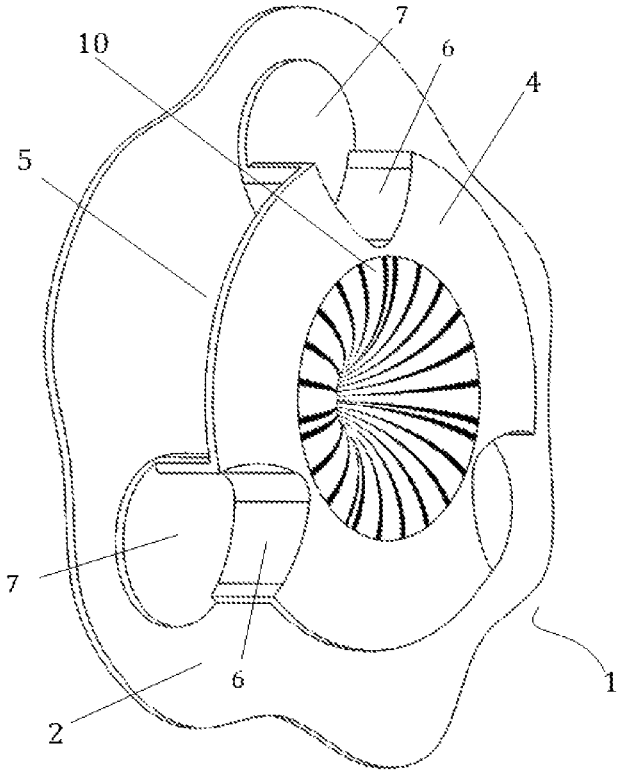
FIGS. 3A and 3B show another embodiment with one inlet opening and three outlets.
Figure 3B:
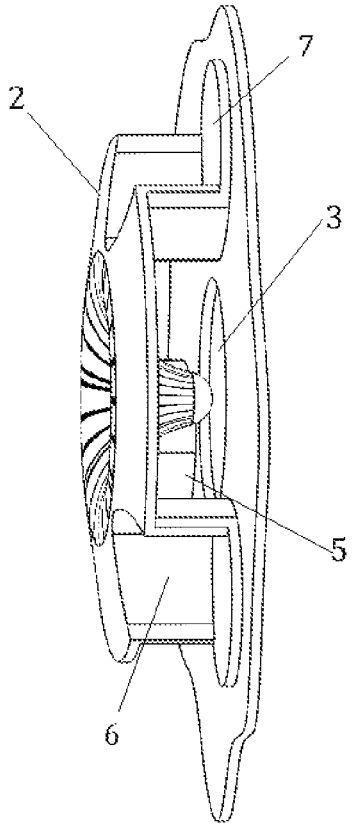

Example 2. The element 1 shown in FIG. 3A-3B comprises a torus surface segment 10 obtained by a horizontal torus cross-section along the torus centroidal axis and a vertical circular cross-section parallel to the torus centroidal axis. The element has one inlet opening 3 and three outlets 5. The curved part 4 on the side of the outlet openings 5 has a substantially straight shape, and the wall of the curved part 4 on the side of the outlet openings 5 is directed towards the flat part 2, making the shape of the element more rounded.

Figure 4A:
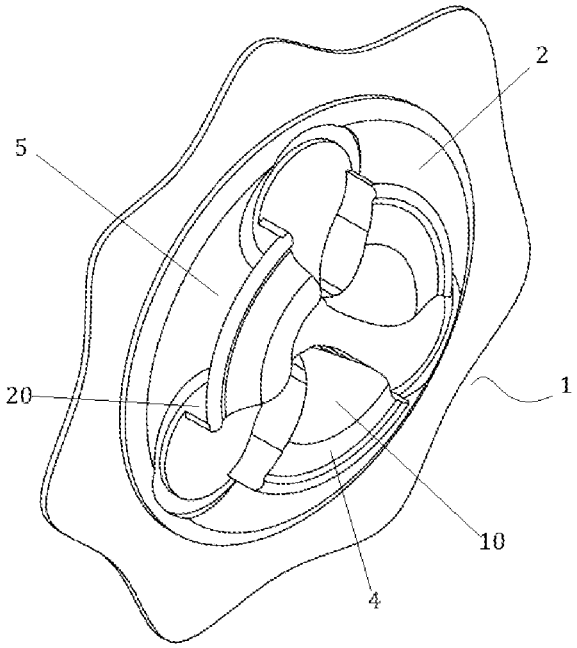
FIGS. 4A and 4B show another embodiment with a segment of the torus surface obtained by an additional two vertical cross-sections directed radially through the centre of symmetry of the torus.
Figure 4B:
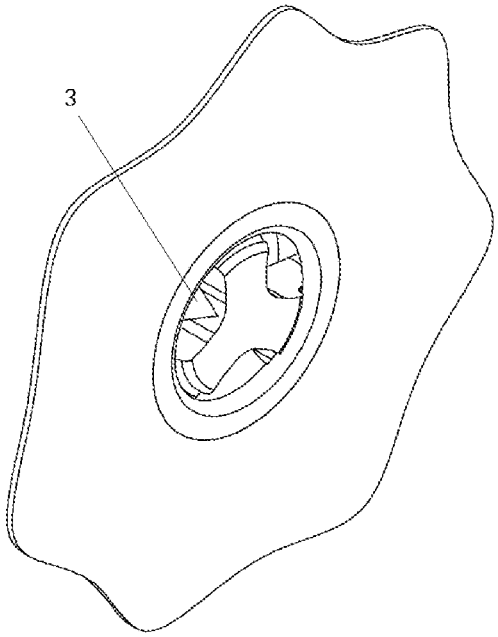

Example 3. The element 1 shown in FIG. 4A-4B comprises segments 10 of the torus surface, each of which is obtained with a horizontal cross-section of the torus along the centroidal axis of the torus, a vertical circular cross-section parallel to the centroidal axis of the torus and in addition two vertical cross-sections directed radially through the centre of symmetry of the torus, with an angle between the planes of 75°. The element has one air inlet opening 3. The element 1 comprises internal partition walls 6 which form three channels terminating in the outlet openings 5. The channels' cross-section extends towards the outlets 5, so that they have a diffuser shape.

Figure 5A:
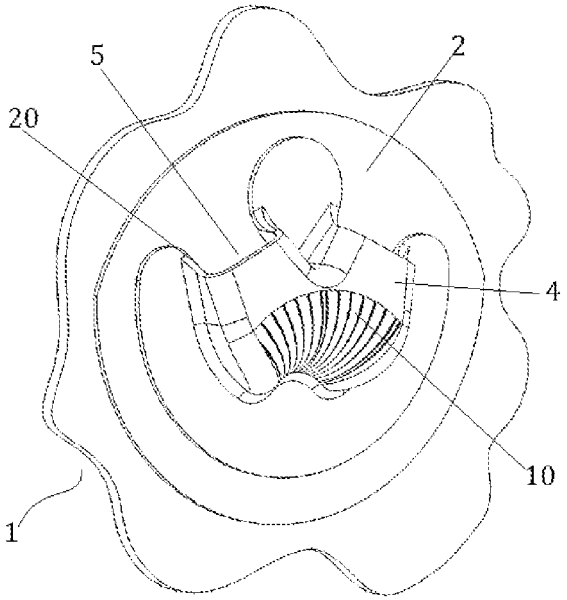
FIGS. 5A and 5B show another embodiment with a segment of the surface of a torus, where the curved part on the side of the outlet opening forms three straight channels.
Figure 5B:
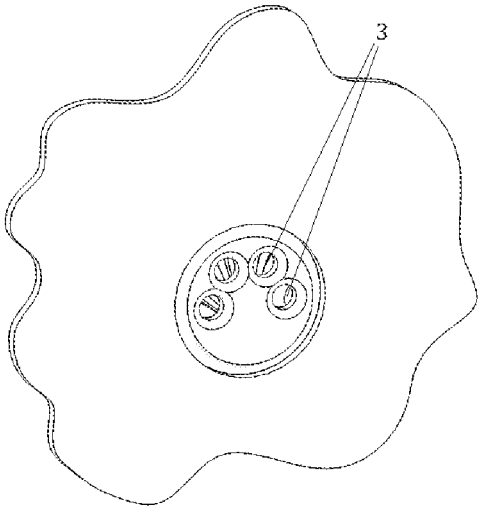

Example 4. The element 1 shown in FIG. 5A-5B comprises a torus surface segment 10 obtained by a horizontal cross-section of the torus along the centroidal axis, a vertical circular cross-section parallel to the centroidal axis of the torus and additional two vertical radially directed sections through the centre of symmetry of the torus, with an angle between the section planes of 237°. The curved part 4 on the side of the outlet opening 5 forms two straight channels. On the external side, the element has four air inlet openings 3. The element 1 according to this example can be used in the production of ventilated rain protection clothing, as it provides free air exchange between the internal micro-environment and the external environment, at the same time due to the upward-facing air outlets 5 (i.e. where the air outlet 5 centres are located above the centres of the air inlet opening 3), preventing water droplets from entering the internal microenvironment from the external environment. In addition, the torus-shaped inner surface of the curved part 4, opposite the air inlet openings 3, allows the water droplets entering the air inlet openings 3 to flow back to the external environment.

Figure 6A:
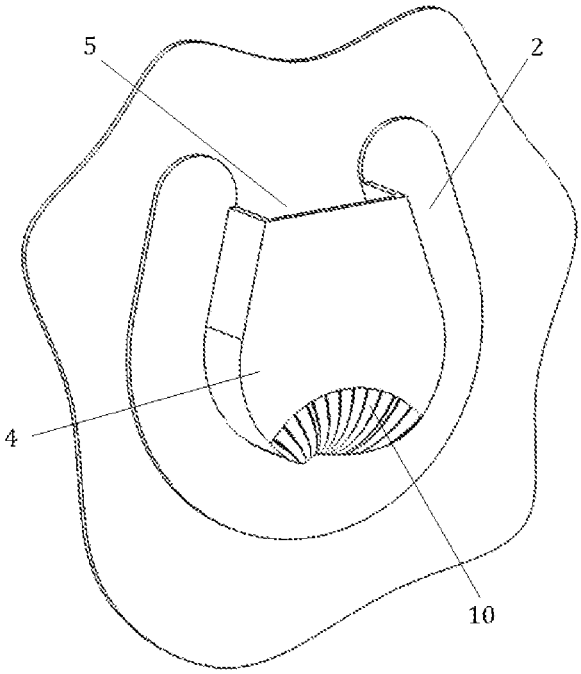
FIGS. 6A, 6B, and 6C another embodiment with a torus surface segment, where the curved part on the side of the outlet opening forms a confusor-shaped channel.
Figure 6B:
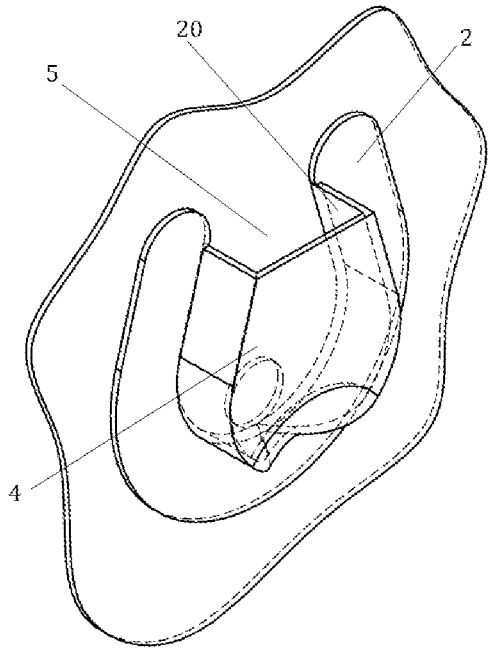
Figure 6C:
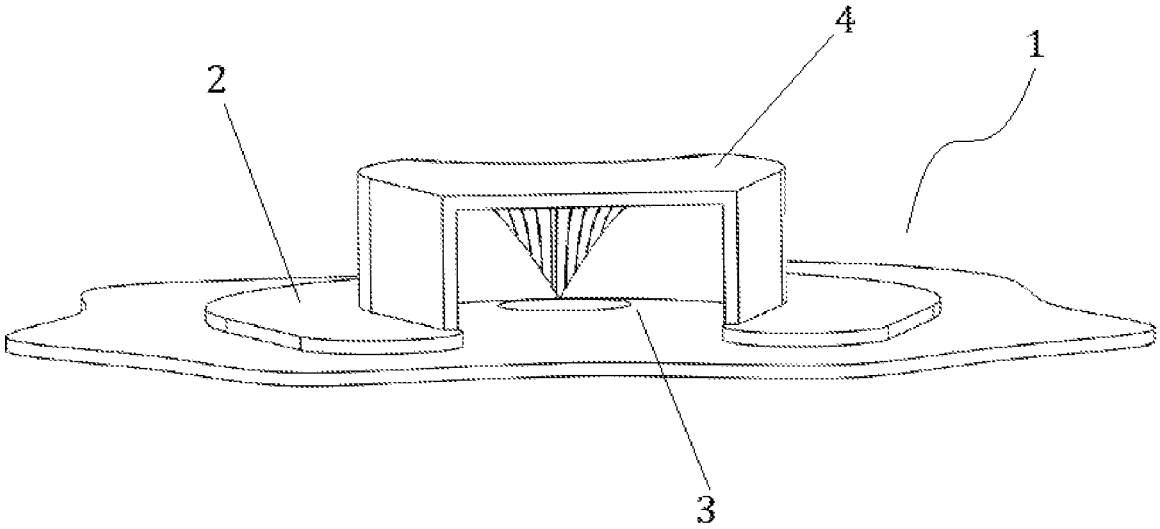

Example 5. The element 1 shown in FIG. 6A-6C comprises a torus surface segment 10 obtained by a horizontal cross-section of the torus along the centroidal axis of the torus, a vertical circular cross-section parallel to the centroidal axis of the torus and additional two vertical sections radially directed through the centre of symmetry of the torus, at an angle between the planes of 315°. The curved part 4 on the side of the outlet opening 5 forms a confusor-shaped channel. The element 1 according to this example can also be used in the production of ventilated rain protection clothing, its elements, blankets, sleeping bags, tents or anti-condensation materials.

At the same time, the element 1 also serves as a spacer between the outer layer of the garment and the body, creating a relatively larger space in which air circulation or body ventilation takes place more freely.

The use of the proposed elements 1 in the production of clothing practically does not change the flexibility of the clothing and does not impair the functionality of the clothing. The elements 1 can also be connected to each other or arranged in a certain order to form a ventilation system. There may be another air-permeable layer (lining) between the elements 1 and the human body to improve the wearer's comfort and the functionality of the garment.

The rounded shape of the element 1 and its parts and the various strength elements improve the required ergonomic and mechanical properties, such as compressive strength, flexibility.

Figure 7A:
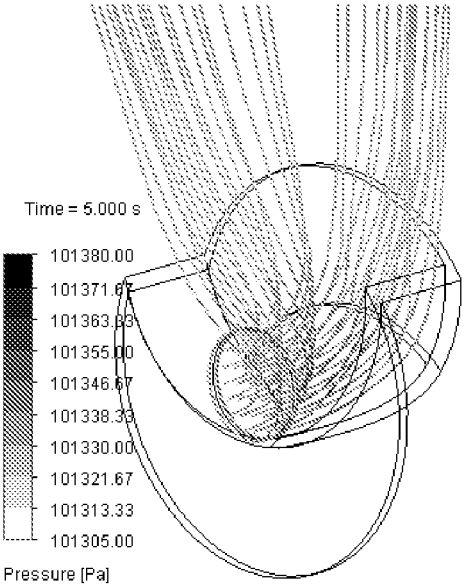
FIGS. 7A, 7B, and 7C—comparative air flow simulation using ventilation element of three different configurations of the inner surface of the curved part, where: EIG. 7A—curved part having torus surface segment configuration (as claimed), FIG. 7B—curved part having cylinder surface segment configuration and FIG. 7C—curved part having ring-arc rotation body surface segment configuration.
Figure 7B:
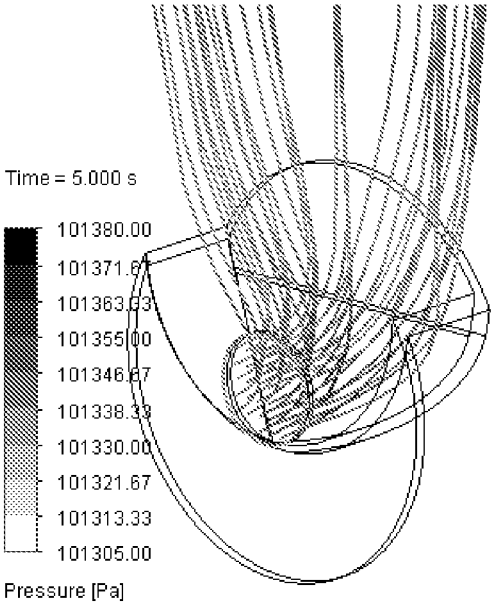
Figure 7C:
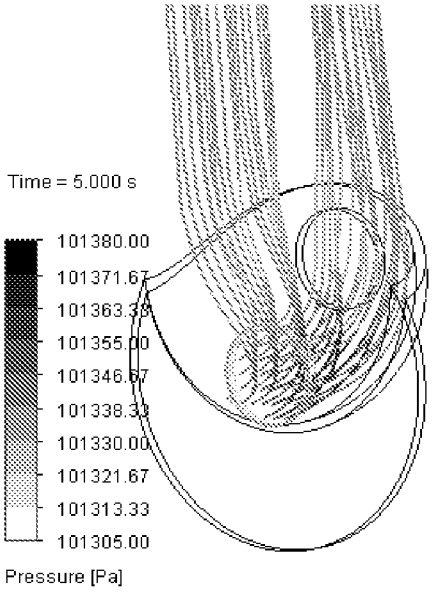

Compared to the prior art solutions, the use of the proposed invention provides a more efficient air exchange between the internal microenvironment and the external environment, significantly better material elasticity and flexibility, which is important for use of the element in clothing. Efficiency of air exchange ensured by three different configurations of the inner surface of the ventilation element's curved part was compared (FIG. 7A-7C). FIG. 7A shows air flow simulation of the ventilation element having torus segment shaped inner surface of the curved part 4; FIG. 7B—air flow simulation of the ventilation element having cylinder segment shaped inner surface of the curved part 4; FIG. 7C—air flow simulation of the ventilation element having ring-arc rotation body shaped inner surface of the curved part 4. One of the important parameters is the maximum dynamic pressure, as it indicates the "compaction" of the flow in certain places, which causes energy losses in the flow. In FIG. 7 the location and intensity of the maximum pressure is shown by flow trajectory lines. The pressure at the inner surface of the element is caused by changing the flow direction by 90° in all three considered variants, however, FIG. 7A shows the lowest maximal pressure. The embodiment as per FIG. 7B shows maximal pressure, which is higher for 6.76 Pa than maximal pressure of the embodiment of FIG. 7A; where the embodiment as per FIG. 7C shows maximal pressure, which is higher for 14.27 Pa than maximal pressure of the embodiment of FIG. 7A. Thus, the claimed shape more effectively diffuses the air flow (Table 1).

TABLE 1

Comparison of air flow passing through three elements

| Inlet velocity angle [°] | Obtained values of study parameters | | Torus surface segment as per FIG. 7A | Cylinder surface segment as per FIG., 7B | Ring-arc rotation body surface segment as per FIG. 7C |
|---|---|---|---|---|---|
| 90 | Pressure [Pa] | Min. | 101305.34 | 101310.55 | 101324.99 |
| | | Max. | 101359.44 | 101366.20 | 101373.71 |
| | | Avg. | 101328.55 | 101328.58 | 101328.57 |

Figure 8:
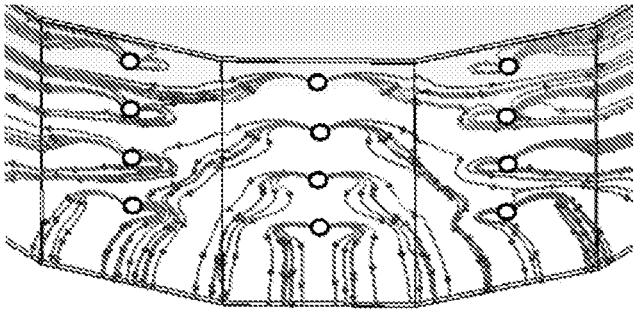
FIG. 8—simulation of air flow distribution using twelve claimed ventilation elements located symmetrically in three parallel vertical lines (four ventilation elements in each vertical line).

FIG. 8 shows air flow distribution using twelve claimed ventilation elements located symmetrically in three parallel vertical lines, four ventilation elements in each vertical line.

Compared to the known solutions, the production process of the proposed element is technologically much simpler. This also reduces production cost of the elements. There are not created difficult-to-wash areas in the proposed element, as are in the case of many prior art solutions, between the upwardly facing part of the element inside the material and the outer layer (fabric).

The invention claimed is:

1. An element for facilitating the exchange of air between an internal micro-environment and an external environment, as well as for anti-insect protection, the element comprising: a substantially flat part with at least one air inlet opening and a substantially curved part with at least one air outlet which is not coaxial with the at least one air inlet opening of the flat part; wherein the shape of the inner surface of the curved part consists of torus surface segment obtained by an intersection of a horizontal cross-section of a torus and a vertical circular cross-section of the torus parallel to the centroidal axis of the torus, the torus surface segment being only a partial surface of the torus; wherein the curved part is connected to the flat part so that all the air inlet openings of the flat part are covered by a wall of the torus surface segment of the curved part and are in communication, with an air exchange possibility, with outlet or outlets of the curved part.

2. The element according to claim 1, wherein the torus surface segment is obtained with additional two vertical cross-sections radially directed through the centre of symmetry of the torus with an angle between the cross-section planes from 9° to 355°.

3. The element according to claim 1, wherein the horizontal cross-section of the torus is along the centroidal axis of the torus.

4. The element according to claim 1, wherein the vertical circular cross-section of the torus is along the centroidal axis of the torus.

5. The element according to claim 1, wherein the element comprises internal partition walls creating and separating air channels of the element from each another.

6. The element according to claim 5, wherein the internal partition walls are attached to base plates, fixed to the flat part.

7. The element according to claim 1, wherein the major radius R1 of the torus, the segment of which is used in the form of the inner surface of the curved part, is from 0 to 50 mm, and the minor radius R2 of the torus is from 0.5 to 49 mm.

8. The element according to claim 1, wherein the inside of the curved part on the side of the outlet opening is confusor-shaped.

9. The element according to claim 1, wherein the inside of the curved part on the side of the outlet opening is diffuser-shaped.

10. The element according to claim 1, wherein the element is made of a resilient material.

11. Use of the element according to claim 1 in the manufacture of air-permeable insect-protective clothing, parts thereof, blankets, tents and/or anti-condensation materials, wherein said element being embedded in clothing, parts thereof, blankets, in tents and/or anti-condensation material so that the curved part of the element faces the internal micro-environment and the flat part faces the external environment.

12. The element according to claim 1, wherein the torus surface segment is obtained with additional two vertical cross-sections radially directed through the centre of symmetry of the torus with an angle between the cross-section planes from 30° to 180°.

* * * * *